United States Patent [19]

Dobson et al.

[11] Patent Number: 4,805,351

[45] Date of Patent: Feb. 21, 1989

[54] BLADE AIRFOIL HOLDING SYSTEM

[75] Inventors: Keith F. Dobson, Liberty; Walter E. Steeves, Greer, both of S.C.

[73] Assignee: Avco Corporation, Providence, R.I.

[21] Appl. No.: 153,263

[22] Filed: Feb. 8, 1988

[51] Int. Cl.[4] ..... B24B 41/06

[52] U.S. Cl. ..... 51/217 R; 51/281 R; 29/156.8 B

[58] Field of Search ..... 51/217 R, 218 R, 281 R; 29/156.8

[56] References Cited

U.S. PATENT DOCUMENTS

| | | | |
|---|---|---|---|
| 2,565,925 | 8/1951 | Lombard et al. | 51/217 R |
| 3,331,166 | 7/1967 | Brenning | 51/217 R |
| 3,818,646 | 6/1974 | Peterson | 51/217 R |
| 4,033,569 | 7/1977 | Dunn | 51/217 R |
| 4,128,929 | 12/1978 | DeMusis | 29/156.8 |
| 4,400,915 | 8/1983 | Arrigoni | 51/217 R |
| 4,589,175 | 5/1986 | Arrigoni | 51/217 R |
| 4,638,602 | 1/1987 | Cavalieri | 51/217 R |

*Primary Examiner*—Frederick R. Schmidt
*Assistant Examiner*—Awni Rifai
*Attorney, Agent, or Firm*—Perman & Green

[57] ABSTRACT

A method and apparatus for accurately positioning successive turbine blades in a fixture in preparation for grinding of the root form and/or of the shroud thereof. The leading edge of the airfoil portion of each blade is supported by a vee block at first and second pairs of spaced locations and the concave surface of the blade is additionally supported adjacent its trailing edge by means of a pad member having a planar surface so oriented that the entire surface thereof coextensive with the concave surface is substantially contiguous therewith. The pad member is also so positioned relative to the vee block to assure a proper chord angle when the turbine blade is mounted on the rotational disk of the engine. In this manner, the stacking axis of each blade is substantially aligned with a predetermined axis within a tolerance range which is always less than the difference in size between a minimum contour and a maximum contour of the airfoil portion.

9 Claims, 3 Drawing Sheets

BLADE AIRFOIL HOLDING SYSTEM

BACKGROUND OF THE INVENTION

1. Field of the Invention

This invention relates generally to turbine blades as for use in a gas turbine engine and, more specifically, to a method of, and apparatus for, assuring that all blades on a rotational disk are balanced and have desired airflow characteristics within predetermined tolerances.

2. Description of the Prior Art

In a turbine assembly such as an aircraft engine or the like, a plurality of turbine blades are connected with and extend radially from a rotational disk or hub. Each blade includes a root form portion which is serrated to fit within similarly configured slots in the disk to lock the blades in place and may have a shroud for holding the blade at its tip end. Each turbine blade has a precise configuration, the tolerances of which are determined by the accuracy of the root form and of the shroud, if it has one.

The present invention relates to a system for securely holding a turbine blade during machining or grinding of the shroud and of the serrations in the root form. In accordance with the invention, the root form and the shroud may be ground more accurately, thereby improving the tolerances of the entire configuration of the blade.

After a turbine blade has been cast, it was known in the art to arrange the airfoil portion of the blade in a mold or matrix block and to fill the mold with molten lead which hardens to form a lead matrix block. Typically, the root form portion of the blade extends from the lead matrix block, the block is mounted in a fixture, and the serrations are ground in the protruding root form portion of the blade.

A major drawback of the use of lead matrix blocks is that the lead is porous and flexible, even when in the solid state. Thus, the lead matrix block cannot be securely held during grinding of the root form, whereby inaccuracies in the root form are developed. Since the root form provides the basis for all of the critical dimensions in the blade, the entire blade will be inaccurate when the root form is not ground to the proper specifications.

Furthermore, the prior methods of manufacture are relatively expensive and time consuming. A major expense is the cost of the lead used to form the lead matrix block for each turbine blade. Additional tooling including the lead mold, the molten lead supply, and the fixture for holding the lead form are also required. Finally, a great deal of time is wasted while waiting for the lead to solidify in the lead matrix form and in breaking the lead away from the blade following the grinding operation.

Turbine blade holding devices are also known in the patented prior art as evidenced by the U.S. Pat. Nos. 3,331,166 to Brenning, 3,331,166 and 4,400,915 to Arrigoni. While these devices normally operate satisfactorily, they are designed for machining the air foil portion of the blade rather than the root form portion.

A significant problem with the prior art resides in its failure to account for variations in the shape and size of an airfoil resulting from the casting operation. No two blades are absolutely identical no matter how carefully the casting process is performed. For that reason, positioning of the blade within a preestablished, but minimized, range of tolerances is important before performing the operation of grinding either the root form or the shroud. A major drawback of known blade holders is that they are incapable of accurately and securely holding a plurality of successive turbine blades during grinding of the root form portions of the blades, whereby each root form, and thus each blade, will be uniform in dimension and configuration.

A further improvement in blade holding devices is disclosed in the U.S. Pat. No. 4,638,602 to Cavalieri. This recent patent discloses a number of arrangements intended to hold a turbine blade relative to its stacking axis during grinding of its root form portion. While Cavalieri mentions a number of designs adapted particularly for use with blades whose thickness varies, they differ considerably with no preferred construction being presented. In some instances, the extreme tip of the airfoil, which is that region most subject to major dimensional variations from one casting to the next, is caused to rest on the datum plate. This positioning of the airfoil would cause precisely the type of problem which the present invention is intended to prevent.

SUMMARY OF THE INVENTION

The present invention was developed to overcome the drawbacks of the prior devices and methods by accommodating for variations in the shape and size of the airfoil while assuring an end product which will have a stacking axis which lies within an acceptable range of tolerances. According to the invention, the desired angular relationship of the airfoil to the root form is also assured.

To this end, the present invention is directed toward a method and apparatus for accurately positioning successive turbine blades in a fixture in preparation for grinding of the root form and/or of the shroud thereof. The leading edge of each blade is supported by, or nested in, a vee block at first and second pairs of spaced locations and the concave surface of the blade is additionally supported adjacent its trailing edge by means of a pad member having a planar surface so oriented that the entire surface thereof coextensive with the concave surface is substantially contiguous therewith. The pad member is also so positioned relative to the vee block to assure a proper chord angle when the turbine blade is mounted on the rotational disk of the engine. In this manner, the stacking axis of each blade is substantially aligned with a predetermined axis within a tolerance range less than that of the airfoil envelope tolerance.

A primary feature of the invention is to compensate for differences or irregularities across the surface of the blade. By causing the leading edge of the blade to nest in the vee block which engages the blade at two longitudinally spaced locations along the length thereof, tilt and lean are avoided. Then, by supporting the concave surface of the blade by means of a pad located at a single location adjacent the trailing edge and intermediate the ends of the blade, the chord angle is properly placed. The foregoing results are achieved with a minimum of structure and operations. Thus, the invention achieves a high degree of accuracy for the manufacture of turbine blades while assuring economy of labor and materials.

Other and further features, objects, advantages, and benefits of the invention will become apparent from the following description taken in conjunction with the following drawings. It is to be understood that the foregoing general description and the following detailed description are exemplary and explanatory but are not to be restrictive of the invention. The accompanying drawings, which are incorporated in and constitute a part of this invention, illustrate one of the embodiments of the invention and, together with the description, serve to explain the principles of the invention in general terms. Like numerals refer to like parts throughout the disclosure.

DETAILED DESCRIPTION OF THE PREFERRED EMBODIMENT

As noted previously, a major consideration of turbine blade manufacturing is the alignment of the mass of the airfoil, as defined by its stacking axis, over the blade attachment device or root form. The root form is generally machined after the airfoil shape is generated. The objective then becomes one of positioning the airfoil center of mass in a consistent manner when presenting the root form for machining. Airfoil shape variations are often of the same magnitude as the tolerance allowed to position the center of mass over the finished root form. These variations must be dealt with during machining to insure correct air flow and balance during engine operation. The present invention accommodates these variations.

Also of primary importance is the angular relationship of the airfoil to the root form. Depending upon the end application of the particular airfoil, this angular relationship may be controlled in different ways. The two most common ways are to control the exit angle when gas reaction vectors are of primary concern or the chord angle when the total assembly throat opening is of primary concern. The present invention also satisfies this requirement to assure the proper angular relationship of the airfoil to the root form.

In short, the invention is a blade airfoil holding system which minimizes the effect of airfoil variations on the center of mass position and angular relationship of the airfoil to root form.

Figure 1:
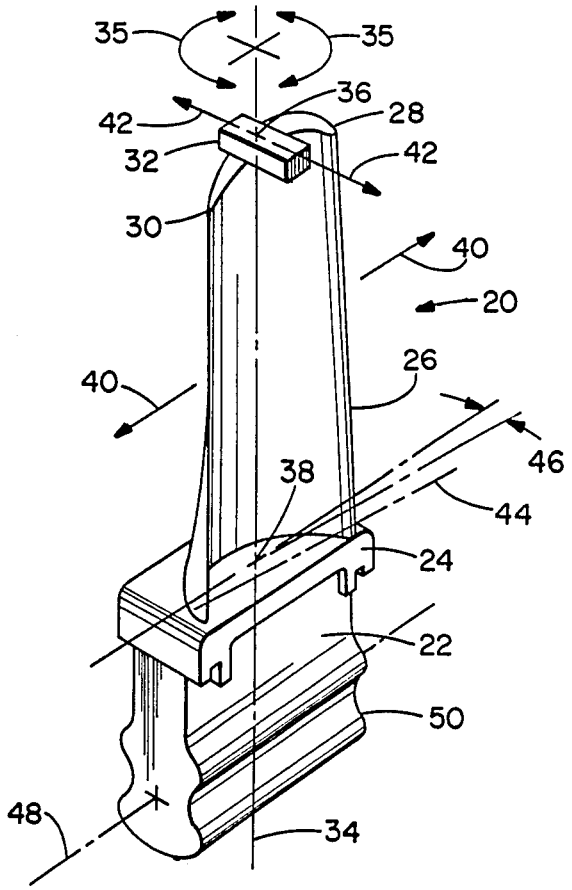
FIG. 1 is a perspective view of a typical turbine blade to which the invention can be applied.

For a complete understanding of and appreciation for the present invention, it is necessary first to describe the design and configuration of a turbine blade 20 which is shown in FIG. 1. The blade includes a root form portion 22, a platform portion 24, an airfoil portion 26 having a leading edge 28 and a trailing edge 30, and an optional shroud 32. Turbine blades are normally cast as an integral unit. Each turbine blade has a stacking axis 34 which corresponds with the centerline of the airfoil portion of the blade, that is, with a line through the centroids of many successive transverse sections through the airfoil portion of the blade. Rotation o the airfoil 26 about the stacking axis 34 is referred to as twist as shown by arrows 35. The point 36 at which the stacking axis 34 emerges from the shroud 32 is the stacking point. A datum point 38 may be located at a predetermined distance from the shroud where the stacking axis enters the same. Where no shroud is provided on the blade, the datum point 38 is located on the platform 24 at a predetermined distance from where the stacking axis passes therethrough.

Deflection of the airfoil 26 from front to rear relative to the root form 22 is referred to as tilt as shown by arrows 40. Deflection of the airfoil 26 from side to side is referred to as lean as shown by arrows 42.

A chord line 44 is that line adjacent the platform 24 and normal to the stacking axis 34 which is defined between the leading and trailing edges of the airfoil portion. The chord angle 46 is defined as the angle between the chord line 44 and a line through the datum point 38 parallel to the root form centerline 48.

The airfoil portion 26 of a turbine blade can be divided into an infinite number of sections which are stacked upon one another. The configuration of each section is designated around the stacking point therefor, the stacking point being located along the stacking axis 34 at the location bisected by the horizontal plane through which an individual airfoil section is taken.

The root form portion 22 of the blade 20 is ground to form a plurality of serrations 50. The orientation of the serrations 50 is critical to insure that the entire blade is properly arranged in a turbine assembly. More particularly, a turbine assembly (not shown) comprises a plurality of turbine blades connected with and extending radially from a central, rotatable disk. The disk contains a plurality of slots or recesses, there being one recess for each blade. Each recess is configured to receive the serrated root form of the blade. For maximum efficiency in operation of the turbine assembly, it is apparent to those skilled in the art that the blades and their root forms must be accurately shaped for cooperation with the other blades of the assembly. Moreover, where the blades are provided with shrouds 32, the shrouds of adjoining blades are designed to be in continuous relation to each other. Thus, to insure proper alignment of the shrouds, the orientation and configuration of the root form serrations are critical.

Figure 2:
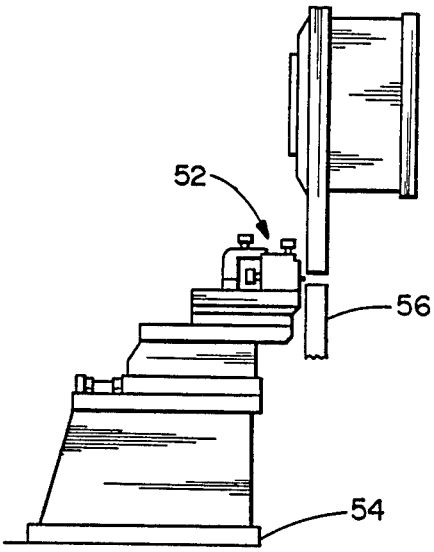
FIG. 2 is a front plan view of a turbine blade holding apparatus according to the invention arranged adjacent a grinding wheel.

Referring now to FIG. 2, a holding fixture 52 according to the present invention is shown mounted in a fixed orientation on a table 54 or the like adjacent a grinding wheel 56. The rotating grinding wheel may be displaced relative to a turbine blade root form secured in the holding fixture in a conventional manner to grind the root form in order to form the serrations 50 therein. A plurality of turbine blade holding devices 52 ma be arranged in parallel opposite the grinding wheel. With such an arrangement, the wheel may be reciprocated adjacent the plurality of turbine blade holders to thereby accurately machine or grind a plurality of root forms substantially simultaneously.

Figure 3:
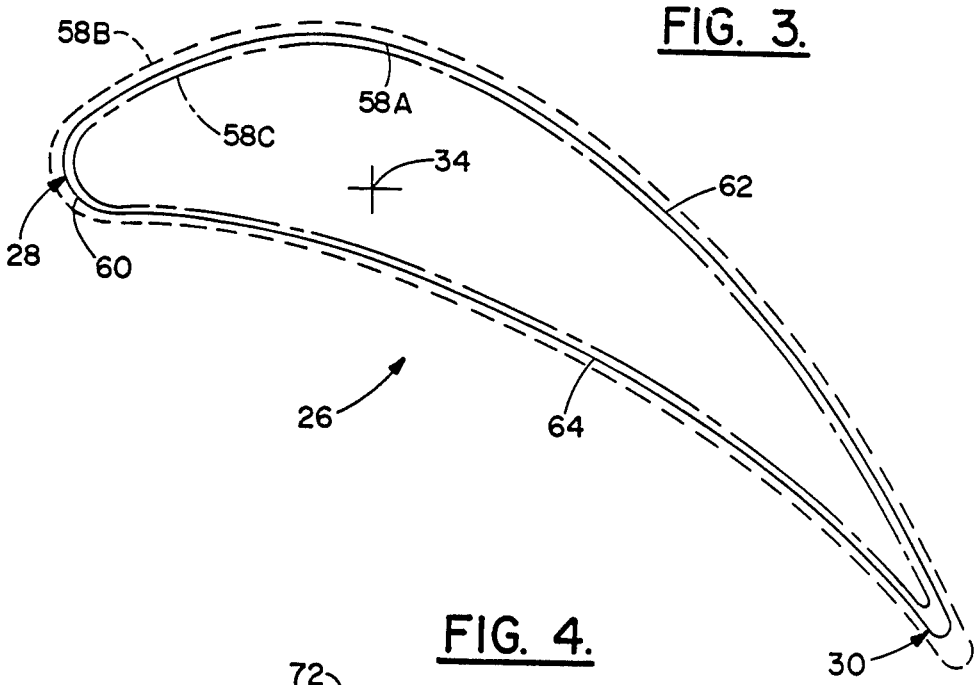
FIG. 3 is a cross section view of an airfoil portion of the blade illustrated in FIG. 1 depicting a range of possible contours following a casting operation forming the blade.

Turn now to FIG. 3 which depicts a cross section of a typical airfoil portion 26 of the blade 20. The casting process for producing a blade is a reasonably accurate one. Nevertheless, the size and shape of the outer contour of one blade will differ from another within a predetermined range of tolerances. Thus, as seen in FIG. 3, a blade with a nominal contour is indicated at 58A, a blade of maximum contour is indicated at 58B, and a blade of minimum contour is indicated at 58C. It will further be appreciated that any one blade may exhibit a maximum contour at one location on its surface and a minimum contour at another location on its surface. However, no blade would have a contour outside of the range depicted, otherwise it would be rejected. Utilizing the nominal contour 58A as depicted in FIG. 3, airfoil portion 26 has a stagnation point 60 which represents a point in the boundary layer of fluid flow across the airfoil in which viscous friction has brought part of the boundary layer to rest. The fluid to one side of this point, which is arbitrarily located in FIG. 3, will flow across the convex side 62 of the airfoil portion and fluid to the other side of this point will flow across the concave side 64 of the airfoil portion. The stagnation point 60 is not a fixed point, but may move through a limited range at the leading edge 28 of the blade depending upon the attitude of the airfoil portion relative to the oncoming flow of air.

With continued attention to FIG. 3, it is clearly seen that the difference between the minimum contour surface and the maximum contour surface at the trailing edge 30 is exaggerated because the contour narrows substantially to a point. For this, and other reasons, it is undesirable to support the blade at the extreme trailing edge. Nevertheless, some prior art holding systems provided for such a support of the blade.

Figure 4:
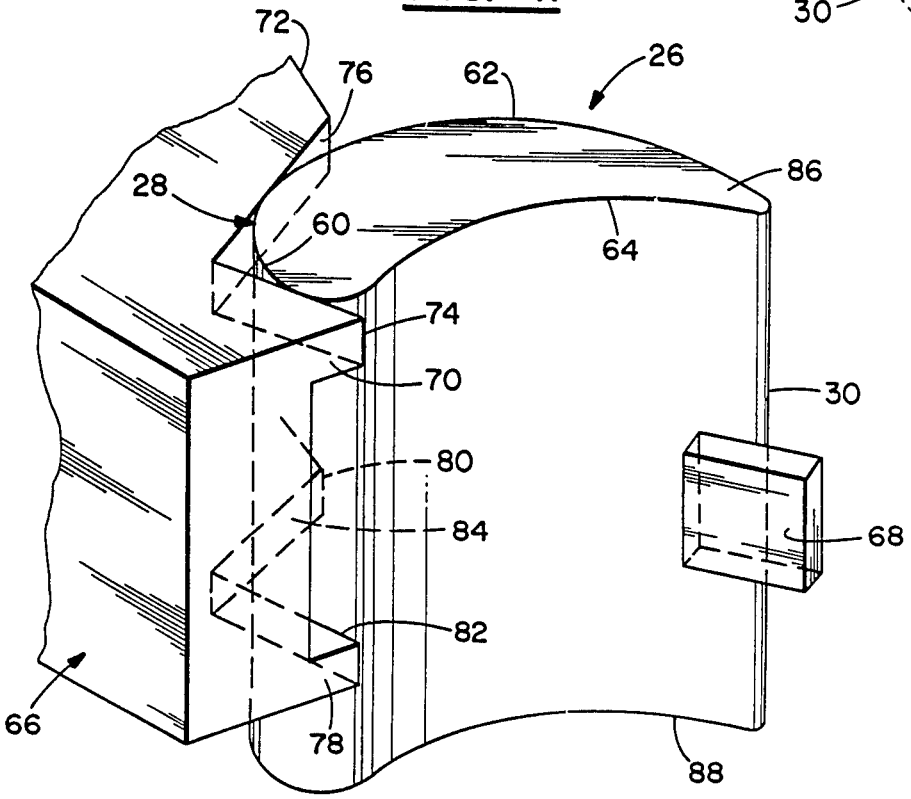
FIG. 4 is a diagrammatic perspective view illustrating the blade positioning apparatus and the method of the invention.

Turn now to FIG. 4 which depicts the primary features of the invention, specifically, the provision and placement of a vee block 66 and of a support pad 68. The vee block 66 and the support pad 68 are fixedly mounted in an appropriate manner on the holding fixture 52. They are specially formed and positioned for each design of blade 20 to be operated upon. That is, with each different blade design, the block 66 will be differently designed as will be the support pad 68 and its position relative to the vee block.

As seen in FIG. 4, the vee block 66 includes first and second cooperating holding members 70 and 72 each of which terminates a blunt surface 74 and 76, respectively. With this arrangement, the holding members 70 and 72 are able to receive the leading edge 28 of the airfoil portion 26 in a nesting relationship. In this regard, nesting can be defined as engaging the leading edge 28 simultaneously at least at one point spaced from the stagnation point 60 in the direction of the convex side 62 and at least at one point spaced from the stagnation 60 in the direction of the concave side 64. This will assure that the airfoil portion 26 will be held such that the angular relationship between the chord line 44 and the root form centerline 48 is maintained substantially constant. In this manner, while the airfoil portion 26 is free to be pivoted along its outer surfaces at its leading edge 28, its translational position is thereby fixed.

A similar arrangement is provided by means of third and fourth holding members 78 and 80, respectively, which similarly terminate at blunt surfaces 82 and 84. The holding members 78, 80 are spaced from the holding members 70, 72. The surfaces 74, 76, 82, and 84 are smooth and preferably flat so as to provide some measure of a bearing surface able to distribute a load without causing any substantial deformation or gouging or scratching of the outer surfaces of the airfoil portion 26. It will also be appreciated that the surfaces 74 and 82 may not, and need not, be coplanar by reason of twist which may be present in the airfoil portion. Similarly, the surfaces 76 and 84 may not, and need not, be coplanar.

When the leading edge 28 of the airfoil portion 26 is fully nested into the vee block 66 as just described, and held in that position, the blade is disposed in a proper manner to assure a desired amount of tilt and lean as previously described. The mutual surfaces 74 and 76 and 82 and 84 may define an appropriate angle between them to assure proper nesting of the airfoil. That is, those surfaces may define an included angle which is obtuse, acute, or right, as desired. In some instances, a particular included angle may be chosen in order to accommodate a parting line formed at the leading edge 28 as a result of the casting process.

With the leading edge 28 of the airfoil portion 26 thereby positioned, the next step in the procedure utilizing the system of the invention is to properly position the trailing edge 30 so that the airfoil portion 26 assumes the correct angle of attack, that is, the correct chord angle 46. The pad 68 is a trailing edge support member which, in cooperation with the vee block 66, is positioned to receivably engage the concave side 64 of the airfoil portion 26 adjacent the trailing edge 30. Thus, the airfoil portion 26 is pivoted in its nested relationship on the vee block 66 until the concave side engages the pad 68. The pad is so formed and positioned as to be substantially coplanar with the concave side 64 of the blade. In this manner, the entire surface of the pad 68 which is coextensive with the concave side 64 is substantially contiguous therewith. The pad 68 is located intermediate a tip end 86 and a platform end 88 of the airfoil portion 26 and, preferably, intermediate generally parallel planes containing the first and second holding members and the third and fourth holding members. As in the instance of the vee block 66, the pad 68 will also be oriented to take into account any twist in the airfoil portion 26.

Figure 5:
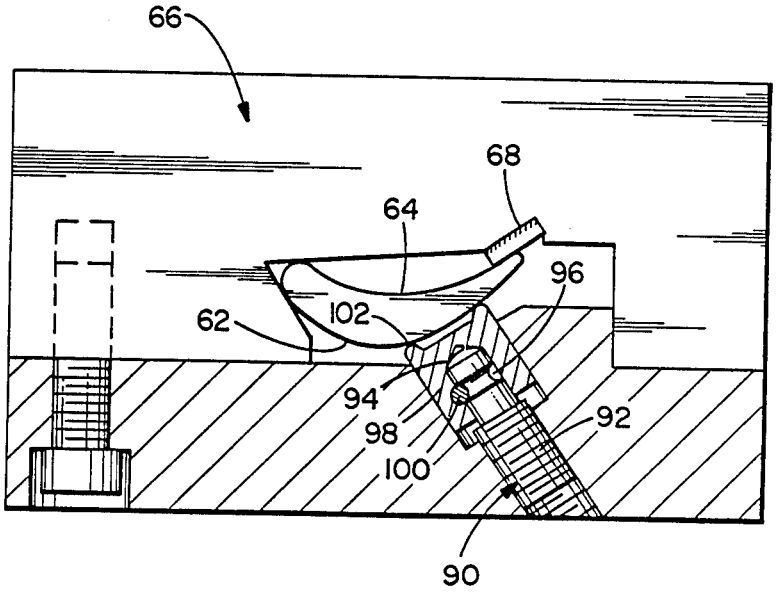
FIG. 5 is a cross section view, certain parts being cut away and in section, illustrating the blade positioning apparatus and the method of the invention.

When the airfoil portion 26 has thus been properly positioned so as to be nested in the vee block 66 and engaged with the pad 68 (see FIG. 5), a clamping member 90 suitably mounted on the holding fixture 52 is brought to bear against the convex side of the airfoil portion 26 to thereby maintain the previously described orientation of the blade 20. The clamping member 90 includes a rod-like arm 92 with a rounded terminal end 94 and an annular groove 96 spaced from the end 94. A cup shaped bearing head 98 is received over the terminal end 94 of the arm 92 and is suitably drilled to receive a holding pin 100 which engages with the groove 96 to secure the bearing head 98 to the arm 92. The extreme end of a bearing head is hollowed out to define an annular rim 102. As the arm 92 is advanced in a direction of the airfoil portion 26, by means of any suitably driven mechanism, the annular rim 12, which is preferably reasonably blunt, will be caused to engage the convex side 62 of the airfoil portion. Since the rim 102 is circular and substantially planar, it engages the convex side 62 at two diametrically opposed locations. By reason of the construction and attachment of the bearing head 98 to the end of the arm 92, small variations, within an acceptable range of tolerances, in the airfoil portion can be accommodated. In this manner, the leading edge of the airfoil portion 26 is held firmly nested in the vee block 66 and the concave side of the airfoil portion 26 is held firmly against the support pad 68. This position of all components is maintained pending completion of the grinding operation on the root form portion 22 and on the shroud 32. When the grinding operations are completed, the clamping member 90 is withdrawn and the blade 20 is removed from the holding fixture 52.

Figure 6:
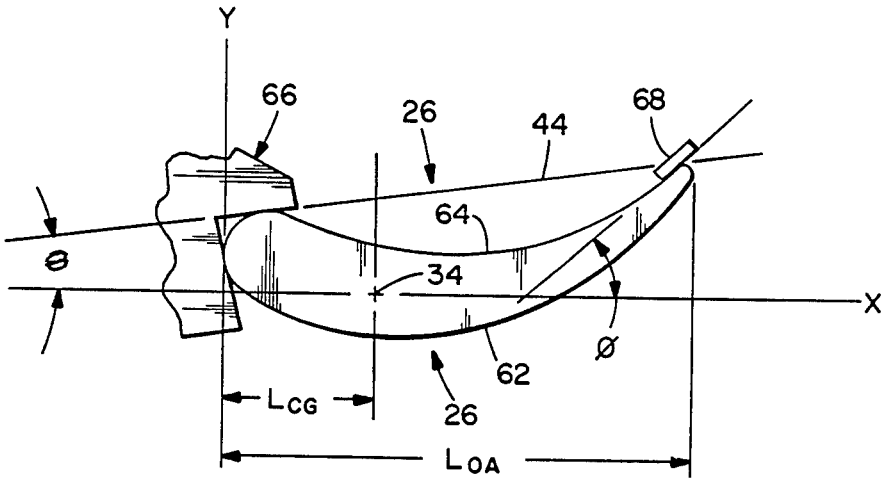
FIG. 6 is a diagrammatic end elevation view illustrating spatial relationships between the blade and the blade positioning apparatus of the invention.

By reason of the invention, the stacking axes 34 of subsequent blades 20 will be maintained within a tolerance range which is less than that of the airfoil envelope tolerance. Specifically, with particular reference to FIG. 6, the shift of the stacking axis 34 from one blade to the next of a given design or contour would never be greater than the product of either the sine or of the cosine of the chord angle and the variation in the contour of the airfoil portion at the leading edge 28 or adjacent to, but not at, the trailing edge.

While a preferred embodiment of the invention has been disclosed in detail, it should be understood by those skilled in the art that various other modifications may be made to the illustrated embodiment without departing from the scope of the invention as described in the specification and defined in the appended claims.

What is claimed is:

1. A method of accurately positioning in a fixture within an acceptable range of tolerances successive turbine blades in an as-cast condition preparatory to grinding of the root form and/or of the shroud thereof wherein each blade has an airfoil portion with convex and concave surfaces and leading and trailing edges extending between the root form at a platform end and the shroud at a tip end distant from the platform end, and a stacking axis intermediate the leading and trailing edges and generally parallel thereto, and wherein the size and shape of each airfoil portion is variable between a minimum contour and a maximum contour, said method comprising the steps of:

supporting the leading edge at least at a first pair of spaced, blunt surfaced, locations and at least at a second pair of spaced, blunt surfaced, locations, the first pair being nearer the tip end than the second pair, one location of each pair being proximate to the convex surface and another location of each pair being proximate to the concave surface; and supporting the concave surface adjacent the trailing edge such that the stacking axis of each blade is substantially aligned with a predetermined axis within a range of movement which is always less dimensionally than the difference between the minimum contour and the maximum contour of the airfoil portion;

wherein the step of supporting the concave surface adjacent the trailing edge includes the step of:

providing a pad member with a substantially planar surface oriented to engageably receive the concave surface of the airfoil portion such that the entire surface of the pad member coextensive with the concave surface is substantially contiguous therewith.

2. A method as set forth in claim 1 wherein the first pair of spaced locations are substantially coplanar, lying in a plane transverse to the stacking axis; and wherein the second pair of spaced locations are substantially coplanar, lying in a plane transverse to the stacking axis.

3. A method as set forth in claim 2 wherein the first and second pairs of spaced locations lie in planes substantially perpendicular to the stacking axis.

4. A method as set forth in claim 3 wherein the pad member is positioned substantially intermediate the planes of the first and second pairs of spaced locations.

5. A method as set forth in claim 1 wherein the step of supporting the concave surface includes the steps of:

locating the trailing edge such that the angle of the chord, a line joining the leading and trailing edges and normal to the stacking axis, relative to an axis of rotation of a disk in which the blade is to be mounted is a predetermined value.

6. A holding system for accurately positioning within an acceptable range of tolerances successive turbine blades in an as-cast condition preparatory to grinding of the root form and/or of the shroud thereof wherein each blade has an airfoil portion with convex and concave surfaces and leading and trailing edges extending between the root form at a platform end and the shroud at a tip end distant from the platform end, and a stacking axis intermediate the leading and trailing edges and generally parallel thereto, and wherein the size and shape of each airfoil portion is variable between a minimum contour and a maximum contour, said system comprising:

vee block means for supporting the leading edge of the blade including:

first and second cooperating holding members having blunt surfaces, said first holding member adapted to receptively and contiguously engage the blade proximate to the convex surface thereof, said second holding member adapted to receptively and contiguously engage the blade proximate to the concave surface thereof; and third and fourth cooperating holding members having blunt surfaces, said third holding member adapted to receptively and contiguously engage the blade proximate to the convex surface thereof at a location spaced from said first holding member, said fourth holding member adapted to receptively and contiguously engage the blade proximate to the concave surface thereof at a location spaced from said second holding member; and said system including:

a trailing edge support member fixed relative to said vee block means having a generally planar surface substantially coplanar with the concave surface of the airfoil portion and adapted to receptively and contiguously engage the concave surface of the blade adjacent the trailing edge thereof such that the stacking axis of each blade supported by said holding system is substantially aligned with a predetermined axis within a range of movement which is always less dimensionally than the difference between the minimum contour and the maximum contour of the airfoil.

7. A holding system as set forth in claim 6 wherein said first and second holding members together lie in a plane which is substantially perpendicular to the stacking axis of the blade; and wherein said third and fourth holding members together lie in a plane which is substantially perpendicular to the stacking axis of the blade.

8. A holding system as set forth in claim 6 including:

positive holding means engageable with the convex surface of the air foil portion for biasing the blade into engagement with said vee block means and said trailing edge support member.

9. A holding system as set forth in claim 6 wherein said planar surface of said trailing edge support member is substantially coplanar with the concave surface of the air foil portion and is positioned so as to locate the trailing edge such that the angle of the chord joining the leading and trailing edges relative to an axis of rotation of a disk in which the blade is to be mounted is a predetermined value.

* * * * *